US008180269B2

(12) United States Patent
Beach et al.

(10) Patent No.: US 8,180,269 B2
(45) Date of Patent: May 15, 2012

(54) RESISTIVE HEATING HOT ROLL FUSER

(75) Inventors: Bradley Leonard Beach, Lexington, KY (US); Jichang Cao, Lexington, KY (US); Ronald Lloyd Roe, Lexington, KY (US); Jerry Wayne Smith, Irvine, KY (US); Scott Shiaoshin Wu, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 236 days.

(21) Appl. No.: 12/271,290

(22) Filed: Nov. 14, 2008

(65) Prior Publication Data

US 2010/0124448 A1 May 20, 2010

(51) Int. Cl.
*G03G 15/20* (2006.01)

(52) U.S. Cl. ..... 399/330; 219/216

(58) Field of Classification Search ..... 399/328, 399/330, 333–335; 219/216
See application file for complete search history.

(56) References Cited

U.S. PATENT DOCUMENTS

| | | | | | |
|---|---|---|---|---|---|
| 4,628,183 | A | * | 12/1986 | Satomura | 219/216 |
| 5,408,070 | A | * | 4/1995 | Hyllberg | 219/469 |
| 5,532,807 | A | * | 7/1996 | Takemoto | 399/335 |
| 5,616,263 | A | * | 4/1997 | Hyllberg | 219/469 |
| 5,659,867 | A | | 8/1997 | Young | |
| 5,729,814 | A | * | 3/1998 | Suzuki et al. | 399/333 |
| 5,822,670 | A | * | 10/1998 | Morigami | 399/334 |
| 5,907,348 | A | | 5/1999 | Ogasawara et al. | |
| 6,101,363 | A | * | 8/2000 | Tomatsu | 399/330 |
| 6,108,906 | A | * | 8/2000 | Fujita et al. | 29/895.211 |
| 6,122,480 | A | | 9/2000 | Hwang | |
| 6,223,017 | B1 | * | 4/2001 | Akutsu et al. | 399/330 |
| 6,393,247 | B1 | | 5/2002 | Chen et al. | |
| 6,470,167 | B2 | * | 10/2002 | Hwang | 399/333 |
| 6,611,670 | B2 | | 8/2003 | Chen et al. | |
| 7,336,919 | B2 | | 2/2008 | Beach et al. | |
| 7,352,988 | B2 | | 4/2008 | Beach et al. | |
| 2006/0275046 | A1 | | 12/2006 | Cao et al. | |
| 2006/0285895 | A1 | | 12/2006 | Beach et al. | |
| 2007/0071529 | A1 | | 3/2007 | Lee et al. | |

FOREIGN PATENT DOCUMENTS

| | | | |
|---|---|---|---|
| JP | 60118868 | A * | 6/1985 |
| JP | 60207170 | A * | 10/1985 |
| JP | 01197779 | A * | 8/1989 |
| JP | 07191566 | A * | 7/1995 |
| JP | 08146804 | A * | 6/1996 |
| JP | 10284217 | A * | 10/1998 |
| JP | 10333473 | A * | 12/1998 |
| JP | 2000331772 | A * | 11/2000 |
| JP | 2003317899 | A * | 11/2003 |

* cited by examiner

*Primary Examiner* — Robert Beatty

(57) ABSTRACT

A fuser roll adapted to fuse toner on the surface of a recording medium is disclosed. The fuser roll includes a non-metallic core having an outer surface, and a resistive heating element covering at least a portion of the outer surface of the core. A current transmitter is provided for transmitting a current to said resistive heating element, and an insulation layer is provided for covering at least a portion of said resistive heating element. A toner release layer is provided for covering at least a portion of said insulation layer.

21 Claims, 3 Drawing Sheets

RESISTIVE HEATING HOT ROLL FUSER

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Invention

The present disclosure relates generally to a fusing member suitable for use in electrophotography for fusing toner on a recording medium, and more particularly to a hot roll fuser member employing resistive heating.

2. Description of the Related Art

Currently, there are two types of fusers used for color laser printers: lamp-heated hot roll fusers and belt fusers. In general color hot roll fusers may provide better fusing quality than belt fusers at a lower cost. However, such hot roll fusers take a relatively long time to heat up, often more than one to several minutes. The lamp-heated roll fuser may be kept hot (above 150° C.) as it waits for the next printing job, however, it is then constantly consuming electrical energy. Conversely, a color belt fuser may heat up very quickly (about 15 seconds). However its design may be more complex and may use more components and cost more to produce. The belt fuser may also have a relatively short life, due to the short life of the steel-rubber belt typically employed by such fusers.

SUMMARY OF THE INVENTION

A resistance-heated fuser roll for electrophotographic devices is provided, comprising a non-metallic core, which may be either solid or hollow. The core may comprise, for instance, quartz, fused silica, ceramic, or a combination thereof. A resistive heating element is disposed on at least a portion of the outer surface of the core and may take different forms such as, for instance, a spiral, an alternating pattern of swept traces, or as bands around the core. The resistive heating element may be formed on the core, for example, by screen-printing or plating or deposition processes, and may comprise, for example, metal, semiconductor material, a blend of metallic particles and high temperature polymers, or a combination thereof.

In one embodiment, the resistive heating element comprises a patterned element. A layer of insulative material (e.g., silicone rubber or other suitable material) may cover at least a portion of the resistive heating element to provide electrical insulation, and a toner release layer may cover at least a portion of the insulative layer. A current transmitter is provided for transmitting a current to the resistive heating element, and in one example embodiment includes a current supplying member and a current receiving member. In one such case, the current receiving member is in electrical contact with said resistive heating element and arranged at both ends of the core, and the current supply member is in sliding contact with said current receiving member. In another such case, the current receiving member comprises a metallic journal fitted to the end of the core and in electrical contact with the resistive heating element. In another such case, the current supply member comprises carbon brushes held in contact with the current receiving member by spring force. In another such case, the current receiving member comprises a metallic end-cap having a concave surface fitted to the end of the core and connected to the resistive heating element using spring force, and the current supplying member comprises carbon brushes in contact with the concave surface of said end-cap.

In another embodiment, the insulation layer comprises an elastomeric layer having a thickness of about 0.1 to 1.5 millimeters. In another specific embodiment, the toner release layer comprises a fluoropolymer material with a thickness of less than or equal to 65 microns. In one such case, the fluoropolymer material may have a thickness of about 5 to 65 microns, including all values and increments therein in 1 micron increments. The toner release layer can be formed, for example, by sleeve, spray coating, dip coating, or a combination thereof. The fuser roll may be installed, for example, in a printer (e.g. color laser printer).

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

DETAILED DESCRIPTION

Figure 1:
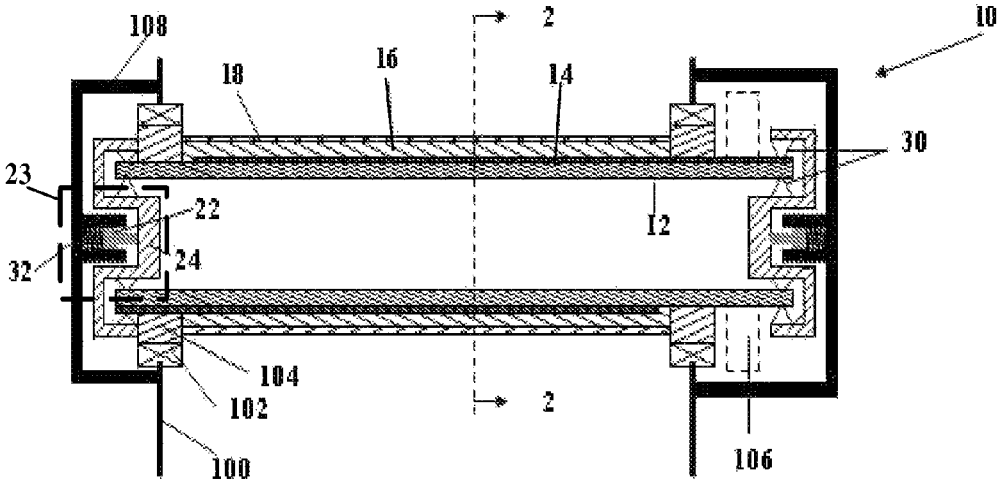
FIG. 1 is a cross-sectional view of a resistive hot roll fuser, configured in accordance with an embodiment of the present invention.
Figure 2:
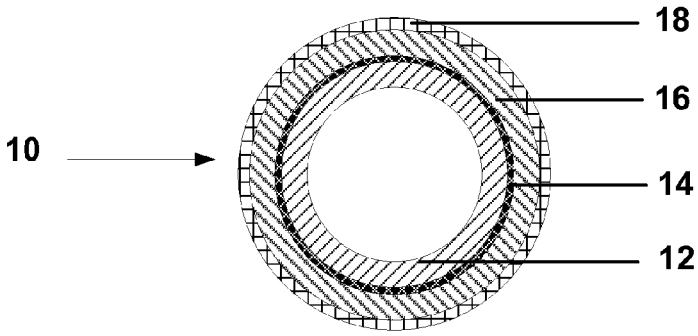
FIG. 2 is a cross-sectional view of the fuser roll of FIG. 1 taken along lines 2-2.

A resistance-heated hot roll fuser 10 is illustrated in cross-section in FIG. 1, and FIG. 2 is a cross-sectional view of the hot roll 10 of FIG. 1 taken along lines 2-2. The roll may comprise a non-metallic core 12 having a solid or tubular cross-section. A resistance heating element 14 is in contact with the outer surface of the core 12. An insulation layer 16 overlies the resistance heating element 14 as electrical insulation and as a compliance layer for improving print quality. A toner release layer 18 overlies the insulation layer 16 for toner release.

Quartz, fused silica, ceramic, plastic, or a combination thereof may be used as materials for the core 12 (which may also be referred to as a substrate roller). Quartz has the advantages of lower thermal conductivity and higher thermal shock resistance. The selection of wall thickness and material for the core 12 may depend on the size of the hot roll 10 and certain material properties, such as thermal conductivity, thermal shock resistance, material strength, and thermal expansion coefficient. To reduce hot roll warm-up time, quartz tube may be used as a core 12 since it has much lower thermal conductivity, higher thermal shock resistance, and much less thermal expansion than ceramic tube. To increase heating element 14 durability, a ceramic tube may be preferred over quartz tube for core 12, because ceramic tube has a higher thermal expansion coefficient than quartz tube and may provide a better match of thermal expansion between heating element 14 and core 12.

The wall thickness of the tubular core 12 may be varied, for example, from about 1 to about 2.5 millimeters, including all values and increments between 1 to 2.5 millimeters. If the wall is too thin, the core may not have sufficient mechanical strength to sustain the force required for toner fusing. If the wall is too thick, the result may be a longer warm-up time due to a larger thermal mass. In one specific embodiment, a quartz tube having a diameter of 30 millimeters and a wall thickness of 1.5 millimeters is used.

The resistance heating element 14 may be provided, for example, in substantially continuous contact with the surface of a non-metallic core 12. This may be accomplished by applying a heating circuit directly to the outer surface of the core 12. In one such embodiment, the resistance heating circuit comprises a thick film resistor that may be screen-printed onto the outer surface of the core 12 using resistive ink, paint, or paste. The heating element 14 may be implemented, for example, with metal, semiconductor material, or a blend of metallic particles and high temperature polymers, or a combination thereof. In some embodiments, the circuit 14 may comprise silver, silver-palladium, or other types of suitable resistive paste. The thickness of such resistive pastes may be about 10 to about 100 microns depending on the resistance of pastes. In other embodiments, resistive heating element 14 can be implemented with a foil circuit, or a thin film deposition of suitable resistive film materials. The resistive heating circuit 14 may be a serial or parallel circuit depending on the resistance of material.

Figure 4:
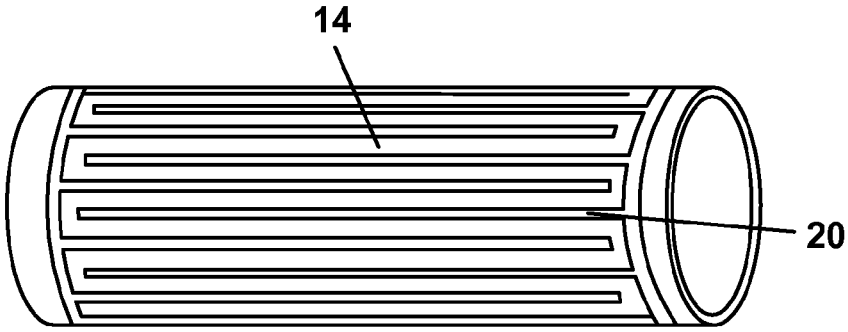
FIG. 4 is a perspective view of a heating circuit for a resistance-heated fuser roll, configured in accordance with an embodiment of the present invention.

The heating element 14 may be applied to have a variety of different patterns, such as a spiral or alternating pattern of swept traces as shown in FIG. 4, or as bands around the core 12. In one example embodiment, the total resistance of the heating element 14 may vary from about 7 to about 15 ohms depending on the requirements for warm-up time and fusing power. The gap 20 shown in FIG. 4 between two film traces may be, for example, about 0.25 to about 1 millimeter. Smaller gaps may provide a more uniform temperature across the surface of the hot roll 10. In the case of a screen-printed paste film, the electric heating circuit 14 may be cured on the outer surface of the core 12 through a thermal process (e.g., firing/sintering). The heating circuit 14 may also be formed with a metal or alloy deposited on the core through an electroless or electrolytic plating process.

As previously explained, the insulation layer 16 provides electrical insulation, and may improve temperature uniformity across the surface of the hot roll 10 and ensure print quality. The insulation layer 16 may be an elastomeric layer that functions as a flexible compliant layer. In one example embodiment, insulation layer 16 is implemented with a silicone rubber layer of about 0.1 to 2 millimeters in thickness, or even more specifically, about 0.5 to 1.5 millimeters in thickness. This silicone rubber layer may be applied, for example, over the heating element 14 and on the outer surface of the core 12. Color electrophotographic toner systems may require improved contact between the fusing member surface and the toner in order to obtain better fusing quality, such as uniform fuse grade and gloss. Silicone rubber is a suitable material because it is soft, has adequate thermal stability, may be made relatively thermally conductive for a polymer. In one embodiment, the silicone layer 16 comprises a thermally conductive silicone rubber having a thickness of about 500 microns.

A toner release layer 18 is provided over the insulation layer 16. The release layer 18, which generally forms the outer surface of the fuser roll 10, may contact the recording medium as the recording medium passes the fusing nip area (not shown). The release layer 18 may be implemented, for example and in accordance with one particular embodiment, with a fluoropolymer layer having a thickness 65 microns or less, including all values and increments therein, in 1 micron steps. For example, a thickness in the range of about 5 microns to about 60 microns, or 6 microns to 60 microns, or 7 microns to 60 microns, or 8 microns to 60 microns, or 5 microns to 59 microns, or 6 microns to 59 microns, etc.

The fluoropolymer (which may be understood as those polymers containing C—F type bonding within a polymer backbone) may be designed to substantially reduce any tendency of the recording medium and toner to adhere to the fuser roll 10 as the recording medium passes the fusing nip area. In one example embodiment, the release layer 18 comprises a relatively low surface energy polymer with high temperature stability, such as a polytetrafluoroethylene or a polyperfluoroalkoxy coating composition. For instance, the release layer 18 may comprise a polytetrafluoroethylene coating with a thickness of about 8 to about 30 microns, or a polytetrafluoroethylene sleeve with a thickness of about 20 to about 30 microns. In some embodiments, the thickness is as thin as possible to improve thermal response, but thick enough to maintain release for the life of the fuser roll. The release layer can be formed, for example, by one of a sleeve (e.g., form-fit, wrap, or shrink-wrap), spray coating, dip coating, or other such suitable forming processes.

Figure 3:
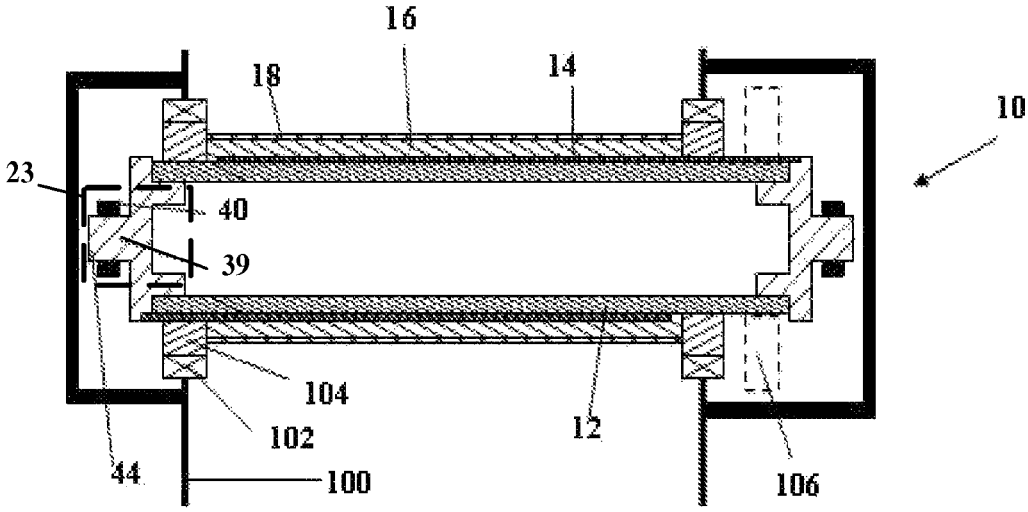
FIG. 3 is a cross-sectional view of a resistive hot roll fuser illustrating a cantilever beam electrical contact, configured in accordance with an embodiment of the present invention.

A current transmitter 23, as shown in FIGS. 1 and 3 may be used to supply electrical current to the resistive heating element 14 at the ends of hot roll 10. The current transmitter 23 can be implemented with a number of current transmitting means, and in the example embodiment shown in FIG. 1 comprises a current supplying member 22 and a current receiving member 24. In one particular such embodiment, the current receiving member 24 comprises a copper or aluminum (or other suitable metal) end-cap or journal that makes electrical contact with the resistive heating element 14 at both ends of hot roll 10 using spring force by way of springs 30 which ensure continuous electrical contact between the current receiving member 24 and heating element 14. The current receiving member 24 may rotate with the hot roll 10 during the printing process without any substantial sliding between the current receiving member 24 and resistive heating element 14. The current supplying member 22 of this example embodiment may be, for example, a carbon brush or disc located at a fixed position and in sliding contact with the current receiving member 24. A spring force, supplied by spring 32, may be applied to the current supplying member 22 to ensure firm electrical contact between the current supplying member 22 and the current receiving member 24. To ensure firm electrical contact between the current supplying member 22 and current receiving member 24 continuously, multiple-point contacts between current supplying member 22 and current receiving member 24 may be adopted. As long as a single point remains in firm contact at any time, an electric spark or arc should not occur since the voltage differences between the current supplying member 22 and receiving member 24 at other points that are not in firm contact are relatively small. The supply element 22 and the receiving element 24 may comprise a wide range of components, as will be apparent in light of this disclosure. In some embodiments, these components are electrically conductive, thermally insulating, resistant to temperatures greater than 180° C., and have a low thermal mass. The current receiving member 24 may comprise a metal or may be non-metallic with a conductive coating to conduct the current. Note that a power source (not shown) is operatively coupled to the current transmitter 23. The power source can be, for example, in or otherwise proximate to a frame 100 that is configured to support the hot roll 10 once installed. Wires can be used to operatively couple the power source to the current transmitter 23 (e.g. to current receiving member 24, such that when the power supply is activate, current flows from the current receiving member 24 to the current receiving member 24).

Figure 5:
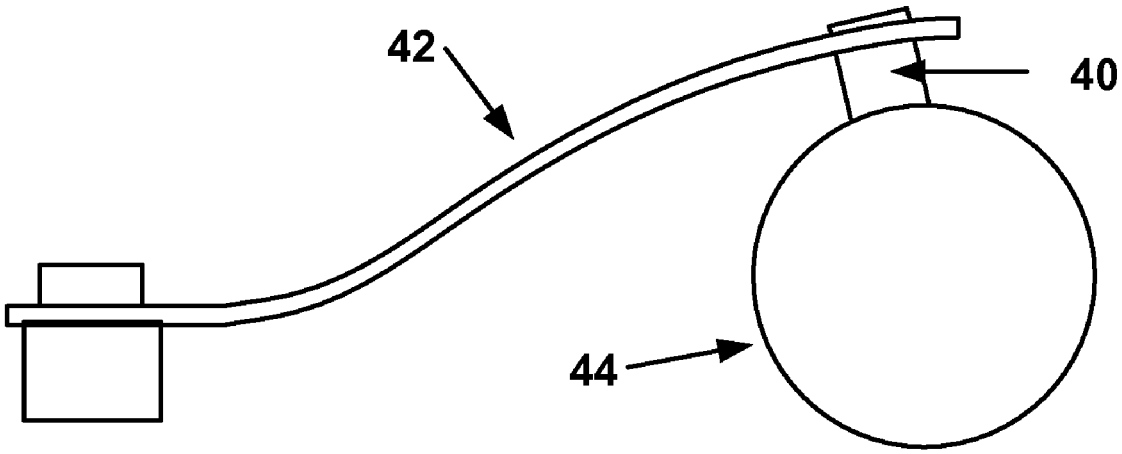
FIG. 5 is an end view of the resistive hot roll of FIG. 3 illustrating a cantilever beam electrical contact, configured in accordance with an embodiment of the present invention.

In a second example embodiment, as shown in FIG. 3, the current transmitter 23 includes current receiving member 39 and current supplying member 40. The current receiving member 39 may be implemented, for example, with a copper or aluminum end-cap, and the current supplying member 40 may be a carbon brush attached to a flexible cantilever beam. The end-cap 39 may be attached to the end of hot roll 10 and connected to resistive heating element 14, for example, using an electrically conductive glue or other suitable electrically conductive bonding material. As shown in end view in FIG. 5, the cantilever beam 42 is operatively coupled to or otherwise integrated with the current supplying member 40, and may be metal and/or carbon or other suitable cantilever material. As further shown in the example embodiment of FIG. 5, the cantilever beam 42 may be deformed as shown so that the flexion force of the beam forces the free end of the cantilever 42 (and more specifically, the current supplying member 40) into sliding contact with the axle 44 of the current receiving member 39. In one example embodiment, two copper cantilever beams 42 each with a carbon block 40 on the tip are used to achieve two points in sliding contact with axle 44 of the end cap 39. The spring force generated by the cantilevering of the beams 42 force the carbon blocks 40 into firm contact with the axle 44 of the current receiving member 39. Electric current may then be conducted to the heating circuit 14 through the carbon blocks 40. The cantilever beam 42 may be attached to the fuser frame and connected to a power source, in a similar fashion as previously discussed.

As indicated in FIGS. 1 and 3, the hot roll 10 may be located inside a fuser frame 100 and cover 108 (each of which can be implemented with metal, plastic, or other suitable material), and supported during rotation by bushings 104 and bearings 102. The roll 10 may be driven by a gear 106. The roll 10 may lie adjacent a backup roll (not shown) to form a fusing nip area where the outer release layer 18 surface of the hot roll 10 may contact the recording medium. Numerous frame and roll actuation schemes may be used in conjunction with embodiments discussed herein, as will be apparent in light of this disclosure.

As a specific example configured in accordance with one embodiment, a resistive heating hot roll fuser 10 was constructed using a quartz tube 12 painted with a resistive circuit 14 on its outside surface. The quartz tube 12 has 1.5 millimeters in wall thickness, and is 30 millimeters in diameter, and 279.4 millimeters in length. The serial resistive circuit 14 was painted on the outer surface of the quartz core 12 using a silver paste. The resistive heating circuit 14 pattern is shown in FIG. 4. The heating circuit 14 was cured through a firing/sintering process as follows: the quartz tube 12 with the circuit pattern 20 painted on its outer surface was placed in a oven and the oven temperature increased at a rate of 10° C. per minute until the oven temperature reached 850° C. The oven temperature was maintained at 850° C. for 10 minutes. The oven was turned off and the tube was kept inside of the oven and allowed to cool gradually. After the heating circuit 14 was cured, a layer of silicone rubber 16 was applied over the surface of the heating element 14 and quartz tube 12, followed by an application of a toner release layer 18 of PFA (polyperfluoroalkoxy-tetrafluorothylene), to form a resistance-heated hot roll fuser 10 in accordance with one embodiment of the present invention.

Testing was carried out to assess the ability of the roll surface to achieve a printing temperature of 170° C. Using a hot roll having a 1.5-millimeter quartz core constructed as described above, the temperature response using various thicknesses of silicone rubber applied for the insulative layer 16 was evaluated. The average heating power during warm-up was 1000 watts. The warm-up times from room temperature (about 20° C.) to a desired print temperature of 170° C. are summarized in Table 1.

TABLE 1

| Thickness of Silicone Layer | Warm-up Time (Ambient to 170° C.) |
|---|---|
| None | 9.6 seconds |
| 0.35 millimeters | 12.1 seconds |
| 0.70 millimeters | 14.8 seconds |
| 1.50 millimeters | 26.7 seconds |

As can be seen, even at a thickness of 1.5 millimeters of silicone, the warm-up time achieved was comparable to known belt fusers.

The mechanical strength of the quartz core for the resistive heating hot roll was also tested. To generate enough nip pressure for achieving the desired fusing quality, about 30-lb. force may be applied at each side of hot roll or backup roll. Therefore, and in accordance with some embodiments, the thickness of a quartz roll must be sufficient to sustain a total 60-lb. force, yet be thin enough to minimize hot roll warm-up time.

To test the mechanical strength of the quartz tube having a 1.5-millimeter thickness, the quartz tube was fixed on the test fixture mounted in an Instron mechanical strength tester. A force was applied to a sliding steel bar to force a backup roll into contact with the quartz tube. The test indicated that a quartz tube having a 1.5-millimeter thickness could sustain greater than 200-lb. force without breaking. Since the quartz tube at 1.5-millimeter thickness is generally much stronger than required, it will be appreciated that the thickness of the tube may be reduced to further reduce the warm-up time due to less thermal mass.

Having described the invention in detail and by reference to specific embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the invention.

What is claimed is:

1. A fuser roll for fusing toner on the surface of a recording medium, comprising:

a non-metallic core having an outer surface;

a resistive heating element having a plurality of resistive film traces arranged to form a substantially serpentine shaped pattern and covering at least a portion of the outer surface of said core, said substantially serpentine shaped pattern having a first terminating end and a second terminating end;

a current transmitter for transmitting a current to said resistive heating element, said current transmitter having a first current supplying member and a first current receiving member in electrical contact with said first terminating end of said substantially serpentine shaped pattern of said resistive heating element, and a second current supply member and a second current receiving member in electrical contact with said second terminating end of said substantially serpentine shaped pattern, the current transmitter further including a first biasing member biasing the current supply member against the current receiving member so as to substantially maintain electrical contact therebetween, said first and second current receiving members respectively being in electrical contact with said first and second terminating ends of said substantially serpentine shaped pattern so as to allow the current to flow from the first terminating end to the second terminating end of said substantially serpentine shaped pattern;

an insulation layer covering at least a portion of said resistive heating element; and a toner release layer covering at least a portion of said insulation layer, wherein said toner release layer comprises a fluoropolymer material.

2. The fuser roll of claim 1, wherein said plurality of film traces are positioned adjacent to each other, each of said plurality of film traces extending in the longitudinal direction of said fuser roll covering at least a portion of the outer surface of said core, each end of each film trace is connected to an end of an adjacent film trace so that said resistive heating element forms said continuous, substantially serpentine-shaped pattern on said core, and a gap existing between two adjacent film traces.

3. The fuser roll of claim 2 wherein said gap ranges from about 0.25 mm to about 1 mm.

4. The fuser roll of claim 1 wherein said non-metallic core comprises quartz, fused silica, ceramic, plastics, or a combination thereof.

5. The fuser roll of claim 1 wherein said resistive heating element comprises metal, semiconductor material, a blend of metallic particles and high temperature polymers, or a combination thereof.

6. The fuser roll of claim 1 wherein said resistive heating element comprises a foil circuit.

7. The fuser roll of claim 1 wherein said resistive heating element comprises a thin film deposition heating element.

8. The fuser roll of claim 1 wherein said resistive heating element comprises metal or alloy deposited on the core through electrolytic or electroless plating.

9. The fuser roll of claim 1 wherein said first current supplying member and said first current receiving member are in sliding contact with each other.

10. The fuser roll of claim 1 wherein each of said first and second current receiving members comprises a metallic journal fitted to an end of said core and in electrical contact with said resistive heating element.

11. The fuser roll of claim 1 wherein each of said first and second current supplying members comprises carbon brushes held in contact with said first and second current receiving members by spring force.

12. The fuser roll of claim 1 wherein each of said first and second current receiving members comprises a metallic end-cap having a concave surface fitted to the end of said core and connected to said resistive heating element using spring force and each of said first and second current supplying members comprises carbon brushes in contact with said concave surface of said end-cap.

13. The fuser roll of claim 1 wherein said insulation layer comprises an elastomeric layer having a thickness of about 0.1 to 1.5 millimeters.

14. The fuser roll of claim 1 wherein said fluoropolymer material has a thickness of about 5 to 65 microns.

15. The fuser roll of claim 1 wherein said toner release layer is formed by one of a sleeve, spray coating, or dip coating.

16. The fuser roll of claim 1 wherein said non-metallic core is hollow.

17. The fuser roll of claim 1 wherein said fuser roll is installed in a printer.

18. The fuser roll of claim 1, wherein the current transmitter further includes a plurality of second biasing members, each second biasing member being coupled between a distinct one of said first and second current receiving members and a distinct one of said first and second terminating ends, so as to substantially maintain electrical contact therebetween.

19. A fuser roll for fusing toner on the surface of a recording medium, comprising:

a non-metallic core having an outer surface;

a resistive heating element having one or more resistive film traces arranged to form a pattern on and covering at least a portion of the outer surface of said core, said pattern having a first terminating end and a second terminating end;

a current transmitter for transmitting a current to said resistive heating element, said current transmitter having a first current supplying member and a first current receiving member in electrical contact with said first terminating end of said pattern of said resistive heating element, and a second current supply member and a second current receiving member in electrical contact with said second terminating end of said pattern, the current transmitter further including a first biasing member biasing the current supply member against the current receiving member so as to substantially maintain electrical contact therebetween, said first and second current receiving members respectively being in electrical contact with said first and second terminating ends of said pattern so as to allow the current to flow from the first terminating end to the second terminating end of said pattern;

an insulation layer covering at least a portion of said resistive heating element; and a toner release layer covering at least a portion of said insulation layer, wherein said toner release layer comprises a fluoropolymer material.

20. The fuser roll of claim 19, wherein the pattern comprises a substantially serpentine shaped pattern.

21. The fuser roll of claim 19, wherein the current transmitter further includes a plurality of second biasing members, each second biasing member being coupled between a distinct one of said first and second current receiving members and a distinct one of said first and second terminating ends, so as to substantially maintain electrical contact therebetween.

* * * * *